US008133192B2

(12) United States Patent
Kang et al.

(10) Patent No.: US 8,133,192 B2
(45) Date of Patent: Mar. 13, 2012

(54) LEG AND FOOT MASSAGE DEVICE CAPABLE OF ACHIEVING FOOT SWING

(75) Inventors: Bingyuan Kang, Zhaoyuan (CN); Jibin Li, Zhaoyuan (CN); Haoheng Luan, Zhaoyuan (CN); Zengxian Wang, Zhaoyuan (CN); Qingyong Chen, Zhaoyuan (CN); Ye Zhu, Zhaoyuan (CN)

(73) Assignee: Shandong Kangtai Industrial Co., Ltd., Shandong Province (CN)

( * ) Notice: Subject to any disclaimer, the term of this patent is extended or adjusted under 35 U.S.C. 154(b) by 901 days.

(21) Appl. No.: 12/219,417

(22) Filed: Jul. 22, 2008

(65) Prior Publication Data

US 2009/0036810 A1 Feb. 5, 2009

(30) Foreign Application Priority Data

Aug. 1, 2007 (CN) ..... 2007 1 0016452

(51) Int. Cl.
*A61H 7/00* (2006.01)

(52) U.S. Cl. ..... 601/90; 601/93; 601/148; 601/151

(58) Field of Classification Search ..... 601/23, 601/24, 26, 27, 29, 31, 32, 34, 35, 49, 51, 601/53, 55, 84–89, 90, 93, 96, 97, 98, 101–105, 601/122, 126, 127, 133, 134, 136, 148–151
See application file for complete search history.

(56) References Cited

U.S. PATENT DOCUMENTS

| | | | | |
|---|---|---|---|---|
| 6,969,361 | B2 * | 11/2005 | Hsieh | 601/127 |
| 7,195,604 | B2 * | 3/2007 | Nakamura et al. | 601/136 |
| 7,273,461 | B2 * | 9/2007 | Baek | 601/151 |
| 7,311,684 | B2 * | 12/2007 | Ishiguro et al. | 601/93 |
| 2005/0288612 | A1 * | 12/2005 | Suzuki | 601/151 |
| 2007/0021694 | A1 * | 1/2007 | Shiraishi | 601/94 |

* cited by examiner

*Primary Examiner* — Quang D Thanh
(74) *Attorney, Agent, or Firm* — Jacobson Holman PLLC

(57) ABSTRACT

The present invention relates to a massage device, and more particularly, to a leg and foot massage device capable of achieving foot swing. The device includes an electrical machinery deceleration element, a wobbler machine element and an air inflatable bag massage element. The electrical machinery deceleration element drives the air inflatable bag massage element through the wobbler machine element, and the electrical machinery realizes the one-off deceleration. Therefore mechanical transmission steps are simplified and transmission noise obviously dropped, wobbler machine element cooperates with air inflatable bags' inflation and deflation, generating many kinds of different massage motions and obtaining a comprehensive massage effect on leg and feet muscles and joints.

12 Claims, 4 Drawing Sheets

LEG AND FOOT MASSAGE DEVICE CAPABLE OF ACHIEVING FOOT SWING

TECHNICAL FIELD

The present invention relates to a massage device, and more particularly, to a leg and foot massage device capable of achieving foot swing.

BACKGROUND OF THE INVENTION

The present leg and foot massage devices are known to have two groups of air inflatable bags that can massage both feet at the same time, after installing, each group of air inflatable bags connects mutually in middle, presents U-shaped configuration and bilateral symmetry, the single side of air inflatable bag is a fold or stack-up structure, and can swell in the horizontal direction after inflating. Air inflatable bags generate motions to achieve inflation and deflation through a variety of different massage procedures produced by the programming control circuit.

With above-mentioned structure, the air inflatable bags' motion is unitary and incapable of massaging body portions very comprehensively, so the device can only obtain a massage effect on human leg and feet muscles, lacks to massage the joint spot effectively and comprehensively.

DISCLOSURE OF THE INVENTION

In view of problems described above, the present invention therefore seeks to provide for a leg and foot massage device having less transmission steps, low noise and that is capable of achieving foot swing, thus massage leg and foot muscles and joints more comprehensive.

To solve the said problems, the present invention adopts the following technical solution:

The electrical machinery deceleration element realized through the worm wheel or the worm. Retarding mechanism decelerates the electrical machinery and after the retardment, the wobbler machine element may adopt two kinds of ways by, firstly, using a crank block to connect, and secondly, using a crank connecting rod to connect. The swing motions may be produced by a swing plate which is driven by a connecting rod. A programmable electric circuit controls the feeding or exhausting air into or from the air inflatable bags, thereby to generate many kinds of different massage motions.

A leg and foot massage device capable of achieving foot swing includes an electrical machinery deceleration element, a wobbler machine element and an air inflatable bag massage element. The electrical machinery deceleration element drives the air inflatable bag massage element through the wobbler machine element, and the electrical machinery realizes the one-off deceleration, with the help of the wobbler machine element cooperating with the air inflatable bags' inflation and deflation to generate many kinds of different massage motions to achieve massage.

The electrical machinery deceleration element mounted on the leg and foot support frame 18 comprises an electrical machinery 1, a worm 2, a worm wheel 3, an upper reduction gearbox housing 4, a lower reduction gearbox housing 5 and a worm-wheel shaft 6. An electrical machinery 1 is decumbent and links the retarding mechanism composed of the worm 2 and the worm wheel 3. The retarding mechanism housing includes the upper reduction gearbox housing 4 and the lower reduction gearbox housing 5. After retarding, the worm-wheel shaft 6 of retarding mechanism connects to the wobbler machine element and outputs power.

The electrical machinery deceleration element can also connect to the wobbler machine element directly by retarding electrical machinery to achieve power output.

The wobbler machine element is composed of crank block mechanism or crank connecting rod mechanism, connecting rod and swing plate;

One embodiment of the said wobbler machine element is described herein. An eccentric gear 7 is fixed in the worm-wheel shaft 6, a deflector rod 8 mounted on an eccentric gear 7 is located at a sliding trough 12. The sliding trough 12 is installed on connecting rod 9, which links the left and right swing plates 10 through a pin roll 19. The left and right swing plates 10 link the leg and foot supporting framework 18 through a rotor shaft 11 to achieve the swing, respectively.

One transformative realization mode of the said wobbler machine element adopts a crank connecting rod mechanism. In this mode, an eccentric gear 7 is fixed in the worm-wheel shaft 6, and links one side of a short connecting rod 12*a* through a short connecting rod pin roll 8*a*. The other side of the short connecting rod 12*a* links the connecting rod 9, the left swing plate 10 or right swing plate 10 through the pin roll 19. The short connecting rod 12*a* pulls one side of the swing plates 10 to achieve swing, and the other side of the connecting rod 9 pulls another side of swing plates 10 to swing through the pin roll 19 at the same time. The left and right swing plates 10 link the leg and foot support frame 18 through a rotor shaft 11 to achieve the swing, respectively.

Another transformative realization mode of the said wobbler machine element is also adopting the crank connecting rod mechanism. The eccentric gear 7 is fixed in the worm-wheel shaft 6 and links both sides of the short connecting rod 12*a* through the short connecting rod pin roll 8*a*. The other sides of both sides short connecting rod 12*a* link the swing plates 10 through a pin roll 19. The short connecting rod 12*a* pulls the swing plates 10 to achieve swing. The left and right swing plates 10 link the leg and foot support frame 18 through a rotor shaft 11 to achieve the swing, respectively.

In another embodiment of the wobbler machine element, the eccentric gear 7 is fixed in the worm-wheel shaft 6 and links one side of the short connecting rod 12*a* through the short connecting rod pin roll 8*a*. The other side of short connecting rod 12*a* links the swing plates 10*a*, which are monolithic and link the leg and foot support frame 18 through a rotor shaft 11.

Air inflatable bag massage element includes a foot inflatable bag group 13, a foot inflatable bag support body 14, a leg inflatable bag group 15, a leg inflatable bag support body 16 and an air source unit 17. The air source unit 17 supplies air source for inflatable bag group, comprising air pump, windpipe, electromagnetic valve, etc. The foot inflatable bag group 13 and the leg inflatable bag group 15 are fixed in the foot inflatable bag support body 14, and the leg inflatable bag support body 16, respectively, so as to nip feet and legs. The foot inflatable bag support body 14, and the leg inflatable bag support body 16 are fixed in the leg and foot supporting framework 18, respectively. When the air source unit 17 moves under the control of a programmable electric circuit, the foot inflatable bag group 13 and the leg inflatable bag group 15 swells and nips the legs and feet. Then the wobbler machine element moves and nips the feet of a user to swing, obtaining the effect of twisting foot joint and massaging leg and feet.

The present invention is a leg and foot massage device capable of achieving foot swing. During the operation of the device, the electrical machinery realizes the one-off deceleration. Therefore, mechanical transmission steps are simplified and transmission noise obviously dropped, consequently to obtain a comprehensive massage effect on leg and feet muscles and joints.

DESCRIPTION OF THE PREFERRED EMBODIMENTS

Embodiments of the invention are described as follows with reference to the drawings wherein:

Embodiment 1

Figure 1:
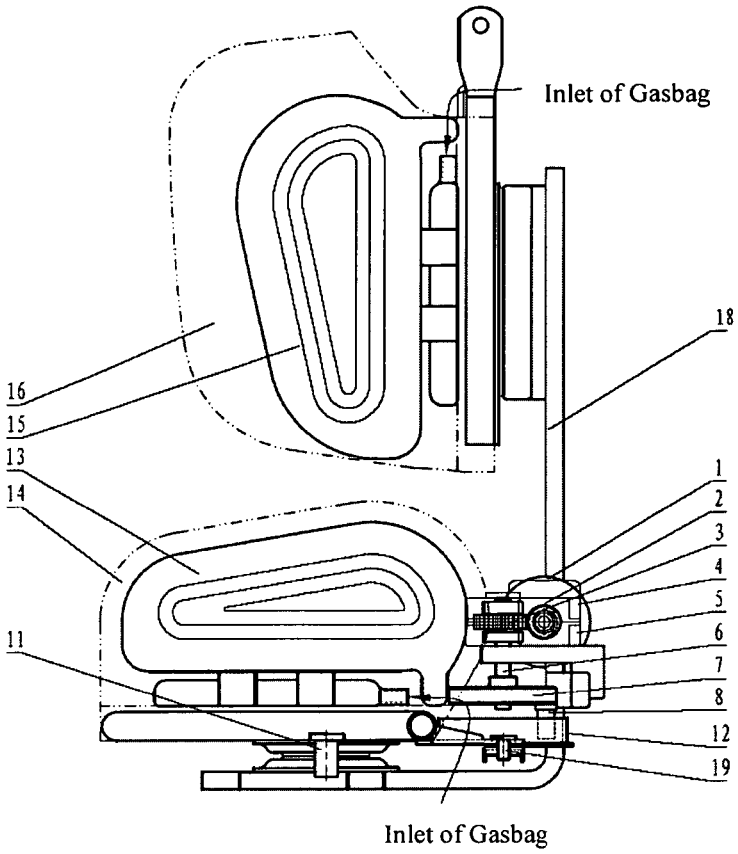
FIG. 1 is a side view of a massage device according to the first embodiment of the present invention.
Figure 2:
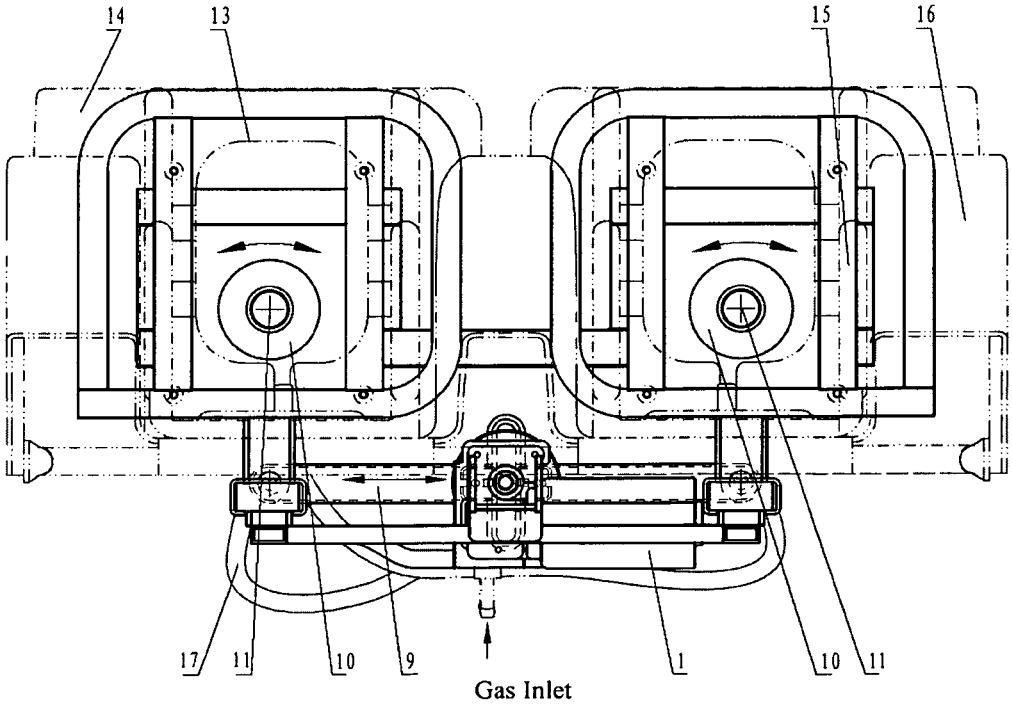
FIG. 2 is a plan view of a massage device according to the first embodiment of the present invention.

As shown in FIG. 1 and FIG. 2, the structure of massage device according to the first embodiment of the present invention is composed of three parts: the electrical machinery deceleration element, the wobbler machine element and the air inflatable bag massage element.

The electrical machinery deceleration element is installed on the leg and foot support frame 18, comprising an electrical machinery 1, a worm 2, a worm wheel 3, an upper reduction gearbox housing 4, a lower reduction gearbox housing 5 and a worm-wheel shaft 6. The electrical machinery is decumbent, after retarding by the worm 2 and the worm wheel 3, the electrical machinery outputs power to the wobbler machine element via a worm-wheel shaft 6 of retarding mechanism.

The wobbler machine element includes an eccentric gear 7, a deflector rod 8, a sliding trough 12, a connecting rod 9, swing plates (left and right) 10, a rotor shaft 11 and a pin roll 19. The eccentric gear 7 is fixed in the worm-wheel shaft 6 and the rotation of which drives the eccentric gear 7 to revolve. The deflector rod 8 mounted on the eccentric gear 7 is located at the sliding trough 12, which is installed on the connecting rod 9. The connecting rod 9 links the swing plates (left and right) 10 through the pin roll 19, left and right foot placed in the swing plates (left and right) 10, respectively, which are eudipleural and link the leg and foot supporting framework 18 through two rotor shafts 11, may rotate the rotor shafts 11 running. When in operation, the eccentric gear 7 rotate per circle, the deflector rod 8 drives the sliding trough 12 and impels the connecting rod 9 to move back and forth continually one time. Simultaneously, the connecting rod 9 drives the swing plates (left and right) 10 rotating around the rotor shafts 11, respectively, to implement wiggly motions.

Figure 3:
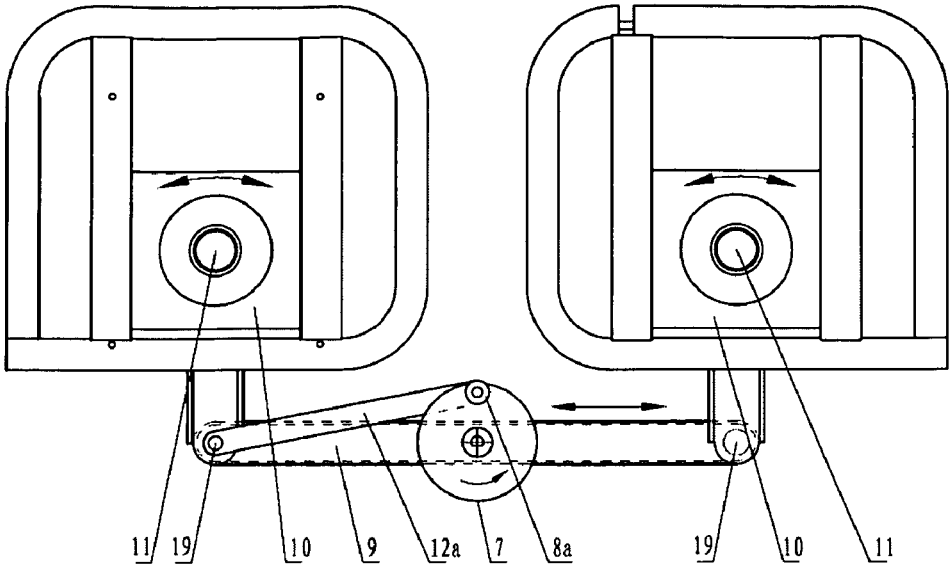
FIG. 3 is a plan view of a wobbler machine element according to the transformative realization mode 1 of first embodiment of the present invention.

The first transformative realization mode of the said wobbler machine element may adopt a crank connecting rod mechanism as shown in FIG. 3. The eccentric gear 7 links the short connecting rod 12*a* through the short connecting rod pin roll 8*a*, the other side of the short connecting rod 12*a* links the connecting rod 9, the left swing plate 10 (or right swing plate 10) through the pin roll 19; the rotation of eccentric gear 7 drives the short connecting rod 12*a* moving, the short connecting rod 12*a* pulls one side of the swing plates 10 to achieve swing, and the connecting rod 9 pulls another side of the swing plates 10 to swing at the same time.

Figure 4:
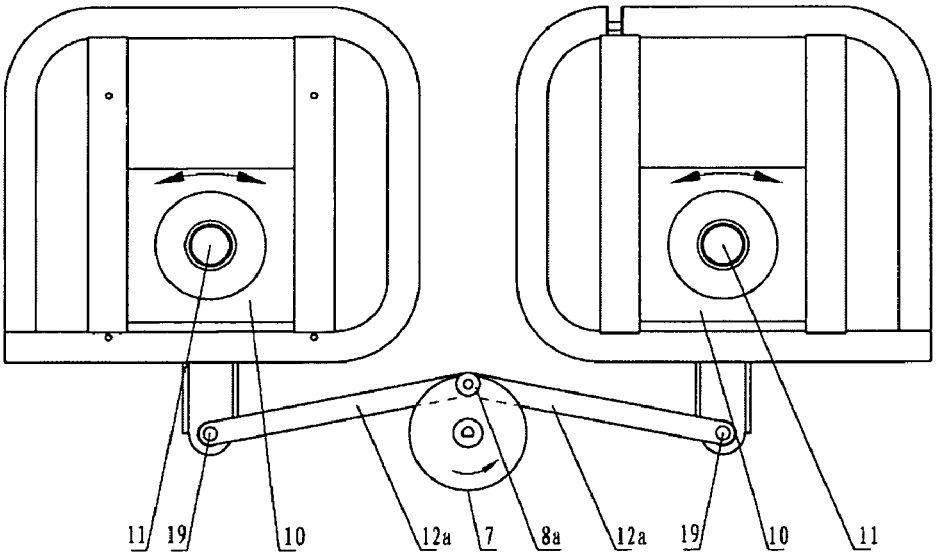
FIG. 4 is a plan view of a wobbler machine element according to the transformative realization mode 2 of first embodiment of the present invention.

The second transformative realization mode of the said wobbler machine element may also adopt the crank connecting rod mechanism as shown in FIG. 4. The eccentric gear 7 links both sides of the short connecting rods 12*a* through the short connecting rod pin roll 8*a*, short connecting rods 12*a* link the swing plates (left and right) 10, respectively. The rotation of the eccentric gear 7 drives the short connecting rods 12*a* moving, and the short connecting rods 12*a* pull the swing plates (left and right) 10 to achieve swing.

The air inflatable bag massage element includes a foot inflatable bag group 13, a foot inflatable bag support body 14, a leg inflatable bag group 15, a leg inflatable bag support body 16 and an air source unit 17. The air source unit 17 supplies air source for the inflatable bag group, comprising an air pump, a windpipe, an electromagnetic valve, etc. The foot inflatable bag group 13 and the leg inflatable bag group 15 are fixed in the foot inflatable bag support body 14, the leg inflatable bag support body 16, respectively, so as to nip feet and legs. When the air source unit 17 moves under the control of a programmable electric circuit, foot inflatable bag group 13 and leg inflatable bag group 15 swell and nip the legs and feet. Then the wobbler machine element moves and nips the feet to swing, obtaining the effect of twisting foot joints and massaging legs and feet.

Embodiment 2

Figure 5:
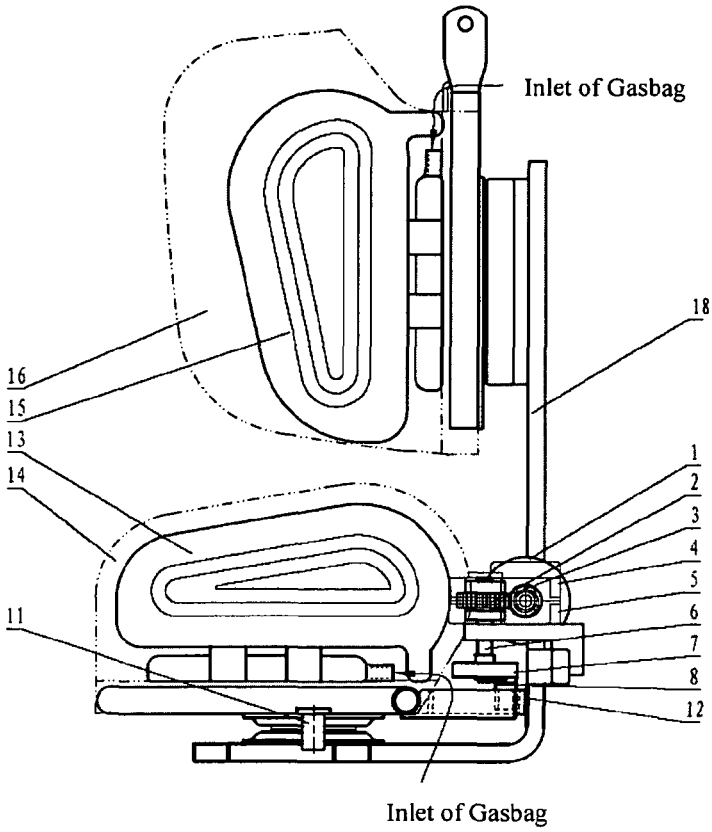
FIG. 5 is a side view of a massage device according to the second embodiment of the present invention.
Figure 6:
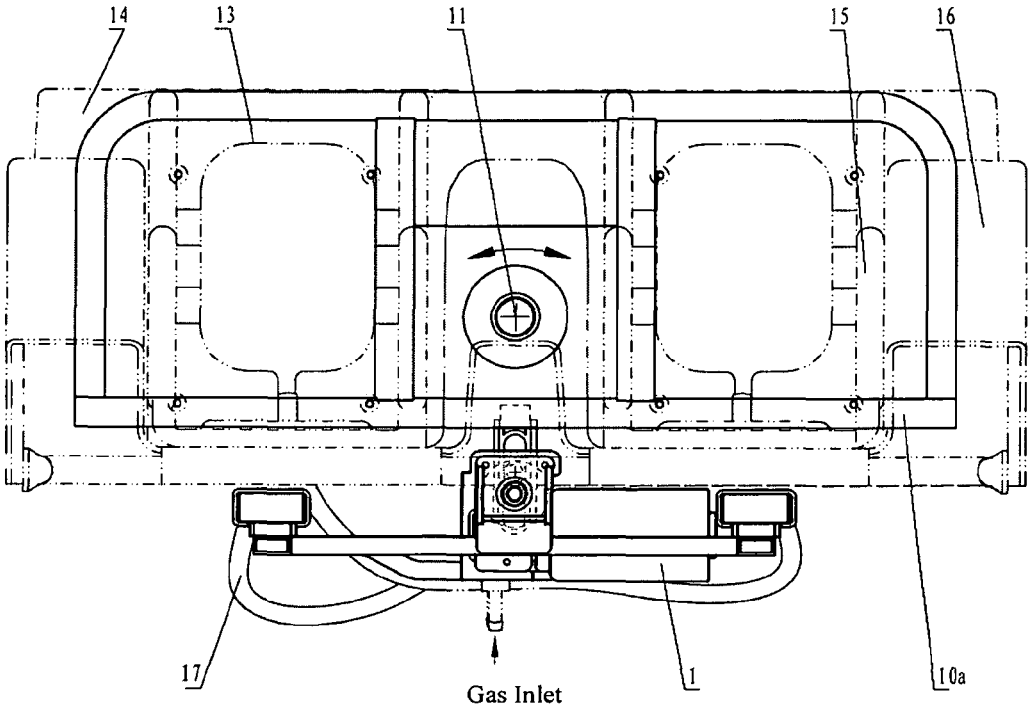
FIG. 6 is a plan view of a massage device according to the second embodiment of the present invention.

FIG. 5 and FIG. 6 do not repeat the same content as shown in FIG. 1 and FIG. 2, and mainly emphasize their similarities and differences. Such embodiment adopting a crank block mechanism with feet being placed in the swing plates 10*a*, which are monolithic and link the leg and foot support frame 18 through the rotor shaft 11. When in operation, the eccentric gear 7 rotates per circle, deflector rod 8 drives the sliding trough 12 and impels the swing plates 10*a* to move directly, to implement wiggly motions.

Figure 7:
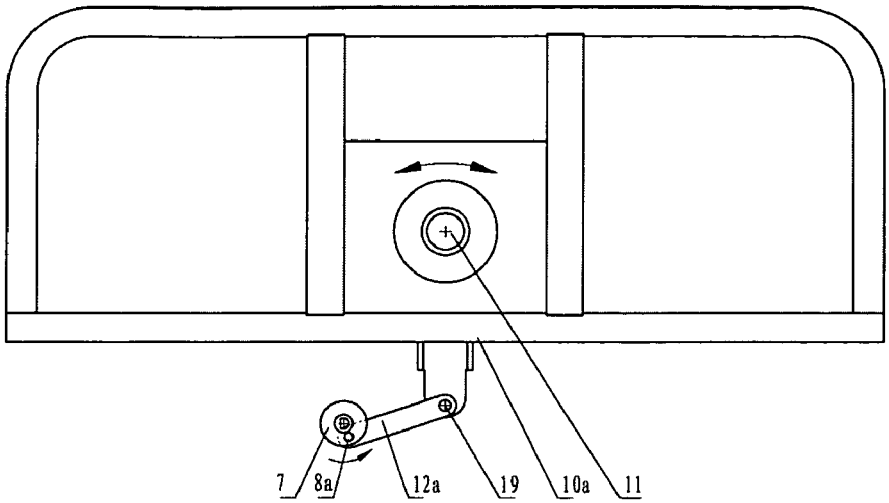
FIG. 7 is a plan view of a wobbler machine element according to the transformative realization mode of second embodiment of the present invention.

In another transformative realization mode of the wobbler machine element as shown in FIG. 7, the structural feature of wobbler machine element is a crank connecting rod organization. The eccentric gear 7 links the short connecting rod 12*a* through the short connecting rod pin roll 8*a*. The other side of short connecting rod 12*a* links the swing plate 10*a* through a pin roll 19. When in operation, the rotation of the eccentric gear 7 drives the short connecting rod 12*a* moving, and the short connecting rod 12*a* pulls swing plate 10 to achieve swing.

Figure 8:
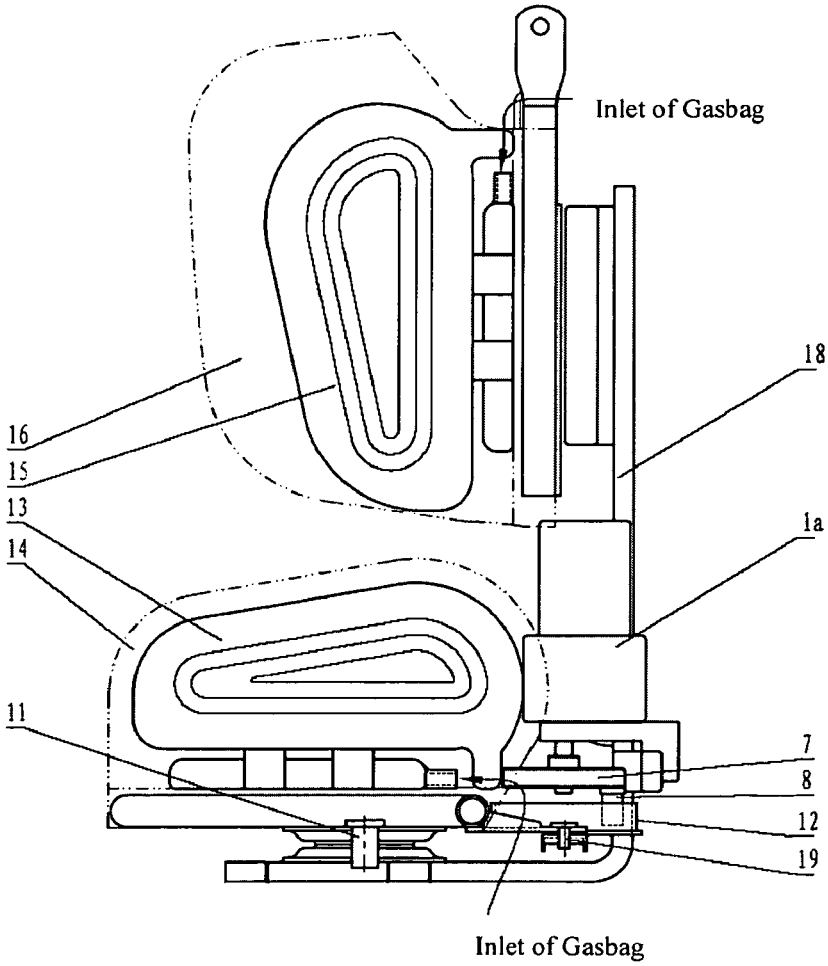
FIG. 8 is a side view of the electrical machinery deceleration element according to the transformative realization mode of first and second embodiments of the present invention.

In the embodiments of FIG. 1 to FIG. 7, the electrical machinery deceleration element may adopt retarding electrical machinery 1*a* directly, as shown in FIG. 8, since retarding electrical machinery was already the mature transmission technology, it is not necessary to describe it in detail.

The invention claimed is:

1. A leg and foot massage device capable of achieving foot swing comprising: an electrical machinery deceleration element, a wobbler machine element and an air inflatable bag massage element, wherein the electrical machinery deceleration element drives the massage element through the wobbler machine element, and the electrical machinery deceleration element achieves deceleration, wherein said wobbler machine element is characterized in that an eccentric gear is fixed in a worm-wheel shaft, a deflector rod mounted on the eccentric gear is located at a sliding trough, the sliding trough is installed on a connecting rod, the connecting rod links left and right swing plates through a pin roll, and the left and right swing plates link a leg and foot supporting framework through a rotor shaft, respectively.

2. The massage device of claim 1, wherein said air inflatable bag massage element comprises a foot inflatable bag group, a foot inflatable bag support body, a leg inflatable bag group, a leg inflatable bag support body and an air source unit, characterized in that, the air source unit supplies air for the foot inflatable bag group comprising an air pump, a windpipe, and an electromagnetic valve, the foot inflatable bag group and the leg inflatable bag group are fixed in the foot inflatable bag support body and the leg inflatable bag support body, respectively, so as to nip feet and legs of an user, the foot inflatable bag support body and the leg inflatable bag support body are fixed in the leg and foot supporting framework, respectively.

3. The massage device of claim 1, wherein said electrical machinery deceleration element which is mounted on the leg and foot supporting framework comprises an electrical machinery, a worm, a worm wheel, an upper reduction gearbox housing, a lower reduction gearbox housing, and a worm-wheel shaft; and wherein the electrical machinery is decumbent and links a deceleration mechanism composed of the worm and the worm wheel, a deceleration mechanism housing composed of the upper reduction gearbox housing and the lower reduction gearbox housing, and the worm-wheel shaft of the deceleration mechanism being connected to the wobbler machine element.

4. A leg and foot massage device capable of achieving foot swing comprising: an electrical machinery deceleration element, a wobbler machine element and an air inflatable bag massage element, wherein the electrical machinery deceleration element drives the massage element through the wobbler machine element, and the electrical machinery deceleration element achieves deceleration, wherein said wobbler machine element includes a crank connecting rod mechanism and is characterized in that an eccentric gear is fixed in a worm-wheel shaft, and links one end of a first connecting rod through a first connecting rod pin roll, another end of the first connecting rod links a second connecting rod, a left swing plate or a right swing plate through a second pin roll, the first connecting rod pulls one side of the swing plate to achieve swing, and another end of the second connecting rod pulls another side of the swing plate to swing through the second pin roll at the same time, the left and right swing plates link a leg and foot supporting framework through a rotor shaft, respectively.

5. The massage device of claim 4, wherein said air inflatable bag massage element comprises a foot inflatable bag group, a foot inflatable bag support body, a leg inflatable bag group, a leg inflatable bag support body and an air source unit, characterized in that, the air source unit supplies air for the foot inflatable bag group comprising an air pump, a windpipe, and an electromagnetic valve, the foot inflatable bag group and the leg inflatable bag group are fixed in the foot inflatable bag support body and the leg inflatable bag support body, respectively, so as to nip feet and legs of an user, the foot inflatable bag support body and the leg inflatable bag support body are fixed in the leg and foot supporting framework, respectively.

6. The massage device of claim 4, wherein said electrical machinery deceleration element which is mounted on the leg and foot supporting framework comprises an electrical machinery, a worm, a worm wheel, an upper reduction gearbox housing, a lower reduction gearbox housing, and a worm-wheel shaft; and wherein the electrical machinery is decumbent and links a deceleration mechanism composed of the worm and the worm wheel, a deceleration mechanism housing composed of the upper reduction gearbox housing and the lower reduction gearbox housing, and the worm-wheel shaft of the deceleration mechanism being connected to the wobbler machine element.

7. A leg and foot massage device capable of achieving foot swing comprising: an electrical machinery deceleration element, a wobbler machine element and an air inflatable bag massage element, wherein the electrical machinery deceleration element drives the massage element through the wobbler machine element, and the electrical machinery deceleration element achieves deceleration, wherein said wobbler machine element includes a crank connecting rod mechanism and is characterized in that an eccentric gear is fixed in a worm-wheel shaft, and links a first end of a first connecting rod and a first end of a second connecting rod through a first connecting rod pin roll, a second end of the first connecting rod and a second end of the second connecting rod link left and right swing plates through a second and a third pin rolls, respectively, the first and second connecting rods pull the swing plates to achieve swing, the left and right swing plates link a leg and foot supporting framework through a rotor shaft, respectively.

8. The massage device of claim 7, wherein said air inflatable bag massage element comprises a foot inflatable bag group, a foot inflatable bag support body, a leg inflatable bag group, a leg inflatable bag support body and an air source unit, characterized in that, the air source unit supplies air for the foot inflatable bag group comprising an air pump, a windpipe, and an electromagnetic valve, the foot inflatable bag group and the leg inflatable bag group are fixed in the foot inflatable bag support body and the leg inflatable bag support body, respectively, so as to nip feet and legs of an user, the foot inflatable bag support body and the leg inflatable bag support body are fixed in the leg and foot supporting framework, respectively.

9. The massage device of claim 7, wherein said electrical machinery deceleration element which is mounted on the leg and foot supporting framework comprises an electrical machinery, a worm, a worm wheel, an upper reduction gearbox housing, a lower reduction gearbox housing, and a worm-wheel shaft; and wherein the electrical machinery is decumbent and links a deceleration mechanism composed of the worm and the worm wheel, a deceleration mechanism housing composed of the upper reduction gearbox housing and the lower reduction gearbox housing, and the worm-wheel shaft of the deceleration mechanism being connected to the wobbler machine element.

10. A leg and foot massage device capable of achieving foot swing comprising: an electrical machinery deceleration element, a wobbler machine element and an air inflatable bag massage element, wherein the electrical machinery deceleration element drives the massage element through the wobbler machine element, and the electrical machinery deceleration element achieves deceleration wherein said wobbler machine element is characterized in that an eccentric gear is fixed in a worm-wheel shaft and links one end of a connecting rod through a connecting rod pin roll, another end of the connecting rod links a swing plate, which are monolithic and link a leg and foot supporting framework through a rotor shaft.

11. The massage device of claim 10, wherein said air inflatable bag massage element comprises a foot inflatable bag group, a foot inflatable bag support body, a leg inflatable bag group, a leg inflatable bag support body and an air source unit, characterized in that, the air source unit supplies air for the foot inflatable bag group comprising an air pump, a windpipe, and an electromagnetic valve, the foot inflatable bag group and the leg inflatable bag group are fixed in the foot inflatable bag support body and the leg inflatable bag support body, respectively, so as to nip feet and legs of an user, the foot inflatable bag support body and the leg inflatable bag support body are fixed in the leg and foot supporting framework, respectively.

12. The massage device of claim 10, wherein said electrical machinery deceleration element which is mounted on the leg and foot supporting framework comprises an electrical machinery, a worm, a worm wheel, an upper reduction gearbox housing, a lower reduction gearbox housing, and a worm-wheel shaft; and wherein the electrical machinery is decumbent and links a deceleration mechanism composed of the worm and the worm wheel, a deceleration mechanism housing composed of the upper reduction gearbox housing and the lower reduction gearbox housing, and the worm-wheel shaft of the deceleration mechanism being connected to the wobbler machine element.

* * * * *